US008031156B2

(12) United States Patent
Jang et al.

(10) Patent No.: US 8,031,156 B2
(45) Date of Patent: Oct. 4, 2011

(54) DATA DRIVING CIRCUIT OF LIQUID CRYSTAL DISPLAY FOR SELECTIVELY SWITCHING AND MULTIPLEXING VOLTAGES IN ACCORDANCE WITH A BIT ORDER OF INPUT DATA

(75) Inventors: Chul Sang Jang, Goyang-si (KR); Jin Chul Choi, Gunpo-si (KR)

(73) Assignee: LG Display Co., Ltd., Seoul (KR)

( * ) Notice: Subject to any disclaimer, the term of this patent is extended or adjusted under 35 U.S.C. 154(b) by 908 days.

(21) Appl. No.: 11/819,939

(22) Filed: Jun. 29, 2007

(65) Prior Publication Data

US 2008/0001149 A1 Jan. 3, 2008

(30) Foreign Application Priority Data

Jun. 29, 2006 (KR) ..... 10-2006-0059347

(51) Int. Cl.
*G09G 3/36* (2006.01)

(52) U.S. Cl. ..... 345/98; 345/89

(58) Field of Classification Search ..... 345/87, 345/89, 98

See application file for complete search history.

(56) References Cited

U.S. PATENT DOCUMENTS

| | | | | |
|---|---|---|---|---|
| 5,805,095 | A * | 9/1998 | Humphreys et al. | 341/144 |
| 6,377,095 | B1 * | 4/2002 | Kuo | 327/170 |
| 6,424,281 | B1 * | 7/2002 | Liaw et al. | 341/144 |
| 6,522,317 | B1 * | 2/2003 | Satou et al. | 345/98 |
| 6,888,216 | B2 * | 5/2005 | Lee et al. | 257/530 |
| 2002/0036610 | A1 * | 3/2002 | Ito et al. | 345/89 |
| 2006/0119563 | A1 * | 6/2006 | Nakamura et al. | 345/98 |

* cited by examiner

*Primary Examiner* — Chanh Nguyen
*Assistant Examiner* — Kwang-Su Yang
(74) *Attorney, Agent, or Firm* — McKenna Long & Aldridge LLP

(57) ABSTRACT

A data driving circuit of a liquid crystal display for selectively switching and multiplexing voltages in accordance with a bit order of input data is disclosed. The data driver circuit includes: a voltage distributor that selects one of a first voltage and a second voltages as first output voltage in accordance with the most significant bit of input data including a plurality of n data bits, that multiplexes the first voltage and the second voltage to be output as one of more multiplexed output voltage is one of the first voltage and the second voltage selected in accordance with bits of the input data lower in significance than the most significant bit, and that outputs the first voltage as a final output voltage; and an output buffer that is driven by the first output voltage, the one or more multiplexed output voltages, and the final output voltage.

15 Claims, 8 Drawing Sheets

FIG. 4

PRIOR ART

| OUTPUT TERMINAL / 3 BITS | Vo1 | Vo2 | Vo3 | Vo4 | Vo5 | Vo6 | Vo7 | Vo8 |
|---|---|---|---|---|---|---|---|---|
| 000 | V1 | V1 | V1 | V1 | V1 | V1 | V1 | V1 |
| 001 | V1 | V1 | V1 | V1 | V1 | V1 | V1 | V2 |
| 010 | V1 | V1 | V1 | V1 | V1 | V1 | V2 | V2 |
| 011 | V1 | V1 | V1 | V1 | V1 | V2 | V2 | V2 |
| 100 | V1 | V1 | V1 | V1 | V2 | V2 | V2 | V2 |
| 101 | V1 | V1 | V1 | V2 | V2 | V2 | V2 | V2 |
| 110 | V1 | V1 | V2 | V2 | V2 | V2 | V2 | V2 |
| 111 | V1 | V2 | V2 | V2 | V2 | V2 | V2 | V2 |

FIG. 7

| 3 BITS \ OUTPUT TERMINAL | Vo1 | Vo1 | Vo1 | Vo1 | Vo2 | Vo3 | Vo4 | Vo5 |
|---|---|---|---|---|---|---|---|---|
| | TO PROCESS AS UPPER 1 BIT | | | | | | | |
| 000 | V1 | V1 | V1 | V1 | V1 | V1 | V1 | V1 |
| 001 | V1 | V1 | V1 | V1 | V2 | V1 | V1 | V1 |
| 010 | V1 | V1 | V1 | V1 | V2 | V2 | V1 | V1 |
| 011 | V1 | V1 | V1 | V1 | V2 | V2 | V2 | V1 |
| 100 | V2 | V2 | V2 | V2 | V1 | V1 | V1 | V1 |
| 101 | V2 | V2 | V2 | V2 | V2 | V1 | V1 | V1 |
| 110 | V2 | V2 | V2 | V2 | V2 | V2 | V1 | V1 |
| 111 | V2 | V2 | V2 | V2 | V2 | V2 | V2 | V1 |

DATA DRIVING CIRCUIT OF LIQUID CRYSTAL DISPLAY FOR SELECTIVELY SWITCHING AND MULTIPLEXING VOLTAGES IN ACCORDANCE WITH A BIT ORDER OF INPUT DATA

This application claims the benefit of Korean Patent Application No. P2006-059347, filed on Jun. 29, 2006, which is hereby incorporated by reference for all purposes as if fully set forth herein.

BACKGROUND OF THE INVENTION

1. Field of the Invention

The present invention relates to a liquid crystal display, and more particularly to a data driving circuit of a liquid crystal display that is adaptive for selectively switching and multiplexing voltages in accordance with a bit order of input data.

2. Discussion of the Related Art

A typical liquid crystal display controls light transmittance of liquid crystal cells in accordance with video signals to thereby display a picture. An active matrix type of liquid crystal display that includes a switching device for each liquid crystal cell is particularly suited for displaying moving pictures through active control of the switching devices. A thin film transistor (hereinafter, referred to as "TFT") is typically used as the switching device in active matrix liquid crystal displays as shown in FIG. 1.

Referring to FIG. 1, a liquid crystal display of the active matrix type converts a digital input data into an analog data voltage on the basis of a gamma reference voltage and supplies the analog data voltage to a data line DL. Concurrently a scanning pulse is supplied to a gate line GL, to turn on the TFT to thereby charge a liquid crystal cell Clc from the analog voltage applied to the data line DL.

A gate electrode of the TFT is connected to the gate line GL, a source electrode is connected to the data line DL, and a drain electrode of the TFT is connected to a pixel electrode of the liquid crystal cell Clc and to an electrode of a storage capacitor Cst.

A common electrode of the liquid crystal cell Clc is supplied with a common voltage Vcom.

When the TFT is turned-on, the storage capacitor Cst charges a data voltage applied from the data line DL and maintains the voltage charged to the liquid crystal cell Clc until a new data voltage is to be charged.

When a gate pulse is applied to the gate line GL, the TFT is turned-on to establish a conductive channel between the source electrode and the drain electrode to thereby supply a voltage on the data line DL to the pixel electrode of the liquid crystal cell Clc. The arrangement of liquid crystal molecules of the liquid crystal cell Clc are controlled by an electric field generated between the pixel electrode and the common electrode to modulate an incident light.

A configuration of a liquid crystal display of the related art including pixels having the above-described structure is shown in FIG. 2.

Referring to FIG. 2, the liquid crystal display 100 of the related art includes a liquid crystal display panel 110, a data driving circuit 120, a gate driving circuit 130, a gamma reference voltage generator 140, a backlight assembly 150, an inverter 160, a common voltage generator 170, a gate driving voltage generator 180, and a timing controller 190.

The liquid crystal display panel 110 includes a liquid crystal layer between two glass substrates. On the lower glass substrate of the liquid crystal display panel 110, the data lines DL1 to DLm and the gate lines GL1 to GLn cross each other with the data lines DL1 to DLm substantially perpendicular to the gate lines GL1 to GLn. The crossings of the data lines DL1 to DLm and the gate lines GL1 to GLn define liquid crystal cells. A TFT is provided at each crossing of a data line DL1 to DLm and a gate line GL1 to GLn. Each TFT supplies a data provided on a data line DL1 to DLm to the liquid crystal cell Clc in response to a scanning pulse applied to the gate electrode of the TFT. The gate electrode of each TFT is connected to one of the gate lines GL1 to GLn while the source electrode of the TFT is connected to one of the data line DL1 to DLm. Further, the drain electrode of each TFT is connected to the pixel electrode of the respective liquid crystal cell Clc and the corresponding storage capacitor Cst.

The TFT is turned-on in response to a scanning pulse applied via a gate line among the gate lines GL1 to GLn connect to the TFT gate. Upon turning-on of the TFT, a video data on the data line among the data lines DL1 to DLm that is connected to the drain of the TFT is supplied to the pixel electrode of a corresponding liquid crystal cell Clc.

The data driving circuit 120 supplies analog data voltages to the data lines DL1 to DLm in response to a data driving control signal DDC that is supplied from the timing controller 190. Further, the data driving circuit 120 samples and latches digital video data RGB that are supplied from the timing controller 190 and then converts latched data into analog data voltages for realizing a gray scale at the liquid crystal cell Clc of the liquid crystal display panel 110 on the basis of a gamma reference voltage supplied from the gamma reference voltage generator 140.

The gate driving circuit 130 sequentially generates a scanning pulse or a gate pulse in response to a gate driving control signal GDC and a gate shift clock GSC supplied from the timing controller 190 to be applied to each of the gate lines GL1 to GLn. The gate driving circuit 130 determines a high level voltage and a low level voltage of the scanning pulse in accordance with the gate high voltage VGH and the gate low voltage VGL supplied from the gate driving voltage generator 180.

The gamma reference voltage generator 140 receives a high-level power voltage VDD to generate a positive gamma reference voltage and a negative gamma reference voltage and supplies the positive and negative gamma reference voltages to the data driving circuit 120.

The backlight assembly 150 is provided at the rear side of the liquid crystal display panel 110, and is energized by an AC voltage and current supplied from the inverter 160 to irradiate a light onto each pixel of the liquid crystal display panel 110.

The inverter 160 converts a square wave signal generated at the interior thereof into a triangular wave signal, and then compares the triangular wave signal with a direct current power voltage VCC supplied from the system to generate a burst dimming signal proportional to the result of the comparison. When the burst dimming signal is generated, a driving integrated circuit IC (not shown) controls a generation of the AC voltage and a current within the inverter 160 to controls the generation of AC voltage and current to be supplied to the backlight assembly 150 in accordance with the burst dimming signal.

The common voltage generator 170 receives a high-level power voltage VDD to generate a common voltage Vcom, and supplies the common voltage Vcom to the common electrode of the liquid crystal cell Clc provided at each pixel of the liquid crystal display panel 110.

The gate driving voltage generator 180 is supplied with a high-level power voltage VDD to generate the gate high voltage VGH and the gate low voltage VGL, and supplies the generated gate voltages to the gate driving circuit 130.

Herein, the gate driving voltage generator 180 generates a gate high voltage VGH having a voltage level greater than a threshold voltage of the TFTs provided at each pixel of the liquid crystal display panel 110 and a gate low voltage VGL a voltage level less then the threshold voltage of the TFTs. The gate high voltage VGH and the gate low voltage VGL generated in this manner are used to establish a high level voltage and a low level voltage respectively of the scanning pulse generated by the gate driving circuit 130.

The timing controller 190 supplies digital video data RGB provided from an external system such as a TV set or a computer monitor, to the data driving circuit 120. In addition, the timing controller 190 generates a data driving control signal DCC and a gate driving control signal GDC using horizontal/vertical synchronization signals H and V in response to a clock signal CLK and supplies the data driving control signal DCC and the gate driving control signal GDC to the data driving circuit 120 and the gate driving circuit 130, respectively. As shown, the data driving control signal DDC includes a source shift clock SSC, a source start pulse SSP, a polarity control signal POL, and a source output enable signal SOE. The gate driving control signal GDC includes a gate start pulse GSP and a gate output enable signal GOE.

The structure and function of a data driving circuit of the related art included in the above described liquid crystal display will be described in detail hereinafter.

Referring to FIG. 3, a data driving circuit 120 of the related art includes a decoder 121, a switching part 122, a multiplexing part 123, and an output buffer 124. The decoder 121 receives 3 bits of data and outputs eight selection signals to the switching part 122. The switching part 122 switches a gamma reference voltage from the gamma reference voltage generator 140 in accordance with eight selection signals from the decoder 121 to output a first voltage V1 and a second voltage V2. The multiplexing part 123 multiplexes the first voltage V1 and the second voltage V2 from the switching part 122 in accordance with a supplied plurality of 3 bit data. In other words, the multiplexer outputs 8 voltages each having output levels of either the first voltage V1 or the second voltage V2, with the pattern of voltage levels among the 8 outputs determined by the supplied 3 bit data. The output buffer 124 is driven by the first voltage V1 and the second voltage V2 that are multiplexed by the multiplexing part 123 to buffer an input data.

The multiplexing part 123 multiplexes the first voltage V1 and the second voltage V2 from the switching part 122 in accordance with a received plurality of 3 bit data to output voltages having the first and second voltage levels, V1 and V2 to selective ones of the first to eighth output terminals Vo1 to Vo8. The multiplexing and outputting functions of the multiplexing part 123 will be described in detail with reference to FIG. 4.

Referring to FIG. 4, if '000' data are received, the multiplexing part 123 multiplexes the first voltage V1 and the second voltage V2 from the switching part 122 to output eight first voltages V1, using the first to eighth output terminals Vo1 to Vo8, to the output buffer 124.

If '001' data are input, the multiplexing part 123 multiplexes the first voltage V1 and the second voltage V2 from the switching part 122 to output seven first voltages V1, via the first to seventh output terminals Vo1 to Vo7, to the output buffer 124, respectively and, at the same time output one second voltage V2, via the eighth output terminal Vo8, to the output buffer 124.

If '010' data are input, the multiplexing part 123 multiplexes the first voltage V1 and the second voltage V2 from the switching part 122 to output six first voltages V1, via the first to sixth output terminals Vo1 to Vo6, to the output buffer 124 respectively and, at the same time output two second voltage V2, via the seven and eighth output terminals Vo7 and Vo8, to the output buffer 124, respectively.

If '011' data are input, the multiplexing part 123 multiplexes the first voltage V1 and the second voltage V2 from the switching part 122 to output five first voltages V1, via the first to fifth output terminals Vo1 to Vo5, to the output buffer 124, respectively and, at the same time output three second voltages V2, via the sixth to eighth output terminals Vo6 to Vo8, to the output buffer 124, respectively.

If '100' data are input, the multiplexing part 123 multiplexes the first voltage V1 and the second voltage V2 from the switching part 122 to output four first voltages V1, via the first to fourth output terminals Vo1 to Vo4, to the output buffer 124, respectively and, at the same time output four second voltages V2, via the fifth to eighth output terminals Vo5 to Vo8, to the output buffer 124, respectively.

If '101' data are input, the multiplexing part 123 multiplexes the first voltage V1 and the second voltage V2 from the switching part 122 to output three first voltages V1, via the first to third output terminals Vo1 to Vo3, to the output buffer 124, respectively and, at the same time output five second voltages V2, via the fourth to eighth output terminals Vo4 to Vo8, to the output buffer 124.

If '110' data are input, the multiplexing part 123 multiplexes the first voltage V1 and the second voltage V2 from the switching part 122 to output two first voltages V1, via the first and second output terminals Vo1 and Vo2, to the output buffer 124, respectively and, at the same time output six second voltages V2, via the third to eighth output terminals Vo3 to Vo8, to the output buffer 124, respectively.

If '111' data are input, the multiplexing part 123 multiplexes the first voltage V1 and the second voltage V2 from the switching part 122 to output one first voltage V1, via the first output terminal Vo1, to the output buffer 124 and, at the same time output seven second voltages V2, via the second to eighth output terminals Vo2 and Vo8, to the output buffer 124, respectively.

The output buffer 124 includes a current source 124-1, eight NMOS transistors N_TR1 to N_TR8, and eight NMOS transistors N_TR9 to N_TR16. The current source 124-1 switches the applied current to a ground. The first eight NMOS transistors N_TR1 to N_TR8 are driven by the first voltage V1 or the second voltage V2 output from the multiplexing part 123 to supply a current from a load 124-2 to the current source 124-1. The second eight NMOS transistors N_TR9 to N_TR16 are driven by a voltage from the load 124-2 to supply a current from the load 124-2 to the current source 124-1. The eight NMOS transistors N_TR1 to N_TR8 and the eight NMOS transistors N_TR9 to N_TR16 are arranged to be symmetrical to each other.

The NMOS transistor N_TR1 includes a gate that is connected to the first output terminal Vo1 of the multiplexing part 123, a drain that is connected to the load 124-2, and a source that is connected to the current source 124-1. The NMOS transistor N_TR1 is driven by the first voltage V1 that is output via the first output terminal Vo1 of the multiplexing part 123 to supply a current from the load 124-2 to the current source 124-1.

The NMOS transistor N_TR2 includes a gate that is connected to the second output terminal Vo2 of the multiplexing part 123, a drain that is connected to the load 124-2, and a source that is connected to the current source 124-1. The NMOS transistor N_TR2 is driven by the first voltage V1 or the second voltage V2 that is output via the second output terminal Vo2 of the multiplexing part 123 to supply a current from the load 124-2 to the current source 124-1.

The NMOS transistor N_TR3 includes a gate that is connected to the third output terminal Vo3 of the multiplexing part 123, a drain that is connected to the load 124-2, and a source that is connected to the current source 124-1. The NMOS transistor N_TR3 is driven by the first voltage V1 or the second voltage V2 that is output via the third output terminal Vo3 of the multiplexing part 123 to supply a current from the load 124-2 to the current source 124-1.

The NMOS transistor N_TR4 includes a gate that is connected to the fourth output terminal Vo4 of the multiplexing part 123, a drain that is connected to the load 124-2, and a source that is connected to the current source 124-1. The NMOS transistor N_TR4 is driven by the first voltage V1 or the second voltage V2 that is output via the fourth output terminal Vo4 of the multiplexing part 123 to supply a current from the load 124-2 to the current source 124-1.

The NMOS transistor N_TR5 includes a gate that is connected to the fifth output terminal Vo5 of the multiplexing part 123, a drain that is connected to the load 124-2, and a source that is connected to the current source 124-1. The NMOS transistor N_TR5 is driven by the first voltage V1 or the second voltage V2 that is output via the fifth output terminal Vo5 of the multiplexing part 123 to supply a current from the load 124-2 to the current source 124-1.

The NMOS transistor N_TR6 includes a gate that is connected to the sixth output terminal Vo6 of the multiplexing part 123, a drain that is connected to the load 124-2, and a source that is connected to the current source 124-1. The NMOS transistor N_TR6 is driven by the first voltage V1 or the second voltage V2 that is output via the sixth output terminal Vo6 of the multiplexing part 123 to supply a current from the load 124-2 to the current source 124-1.

The NMOS transistor N_TR7 includes a gate that is connected to the seventh output terminal Vo7 of the multiplexing part 123, a drain that is connected to the load 124-2, and a source that is connected to the current source 124-1. The NMOS transistor N_TR7 is driven by the first voltage V1 or the second voltage V2 that is output via the seventh output terminal Vo7 of the multiplexing part 123 to supply a current from the load 124-2 to the current source 124-1.

The NMOS transistor N_TR8 includes a gate that is connected to the eighth output terminal Vo8 of the multiplexing part 123, a drain that is connected to the load 124-2, and a source that is connected to the current source 124-1. The NMOS transistor N_TR8 is driven by the first voltage V1 or the second voltage V2 that is output via the eighth output terminal Vo8 of the multiplexing part 123 to supply a current from the load 124-2 to the current source 124-1.

The eight NMOS transistors N_TR9 to N_TR16 each have a gate and a drain that are connected to the load 124-2, and a source that is connected to the current source 124-1. The eight NMOS transistors N_TR9 to N_TR16 are each driven by a voltage from the load 124-2 to supply a current from the load 124-2 to the current source 124-1.

As described above, in the data driving circuit of the related art, the multiplexing part 123 receives n bits data to output $2^n$ voltages to the output buffer 124. Thus, the number of output terminals of the multiplexing part 123 and the number of signal lines connected to the output terminal are doubled for each unit increase in the number of bits of input data. As a result, there is a problem in that the data driving circuit has a complex structure and occupies a large area.

SUMMARY OF THE INVENTION

Accordingly, the present invention is directed to a data driving circuit of a liquid crystal display that substantially obviates one or more of the problems due to limitations and disadvantages of the related art An advantage of the present invention is to provide a data driving circuit of a liquid crystal display that is adaptive for selectively switching and multiplexing voltages in accordance with a bit order of input data.

Another advantage of the present invention is to provide a data driving circuit of a liquid crystal display that is adaptive for simplifying a structure of the circuitry and reducing the area occupied by the circuitry by selectively switching and multiplexing voltages in accordance with a bit order of input data.

Additional features and advantages of the invention will be set forth in the description which follows, and in part will be apparent from the description, or may be learned by practice of the invention. These and other advantages of the invention will be realized and attained by the structure particularly pointed out in the written description and claims hereof as well as the appended drawings.

To achieve these and other advantages and in accordance with the purpose of the present invention, as embodied and broadly described a data driving circuit of a liquid crystal display is provided that includes: a voltage distributor that selects between outputting a first voltage and a second voltage as first output voltage in accordance with the most significant bit of input data including a plurality of n data bits, that multiplexes the first voltage and the second voltage to be output as one or more multiplexed output voltages wherein each of the one or more multiplexed output voltages is a voltage level of one of the first voltage and the second voltage selected in accordance with bits of the input data other than the most significant bit, and that outputs the first voltage as a final output voltage; and an output buffer that is driven by the first output voltage, the multiplexed output voltage, and the final output voltage.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings:

FIG. 4 is a diagram for explaining an operation of the data driving circuit of the related art;

FIG. 7 is a diagram for explaining an operation of the data driving circuit according to the embodiment of the present invention.

DETAILED DESCRIPTION OF THE ILLUSTRATED EMBODIMENTS

Reference will now be made in detail to an embodiment of the present invention, an example of which is illustrated in the accompanying drawings. Wherever possible, the same reference numbers will be used throughout the drawings to refer to the same or like parts.

Figure 1:
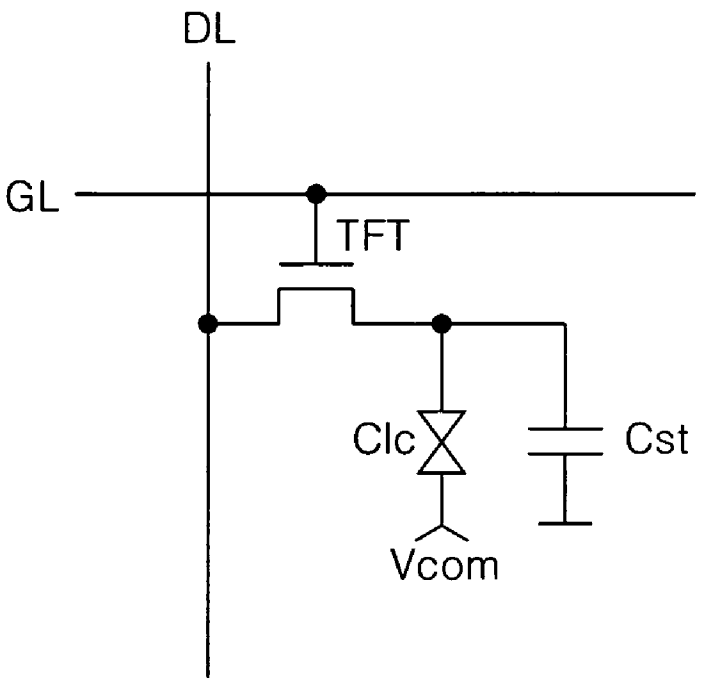
FIG. 1 RELATED ART
FIG. 1 is an equivalent circuit diagram showing a pixel provided at a liquid crystal display of the related art.
Figure 2:
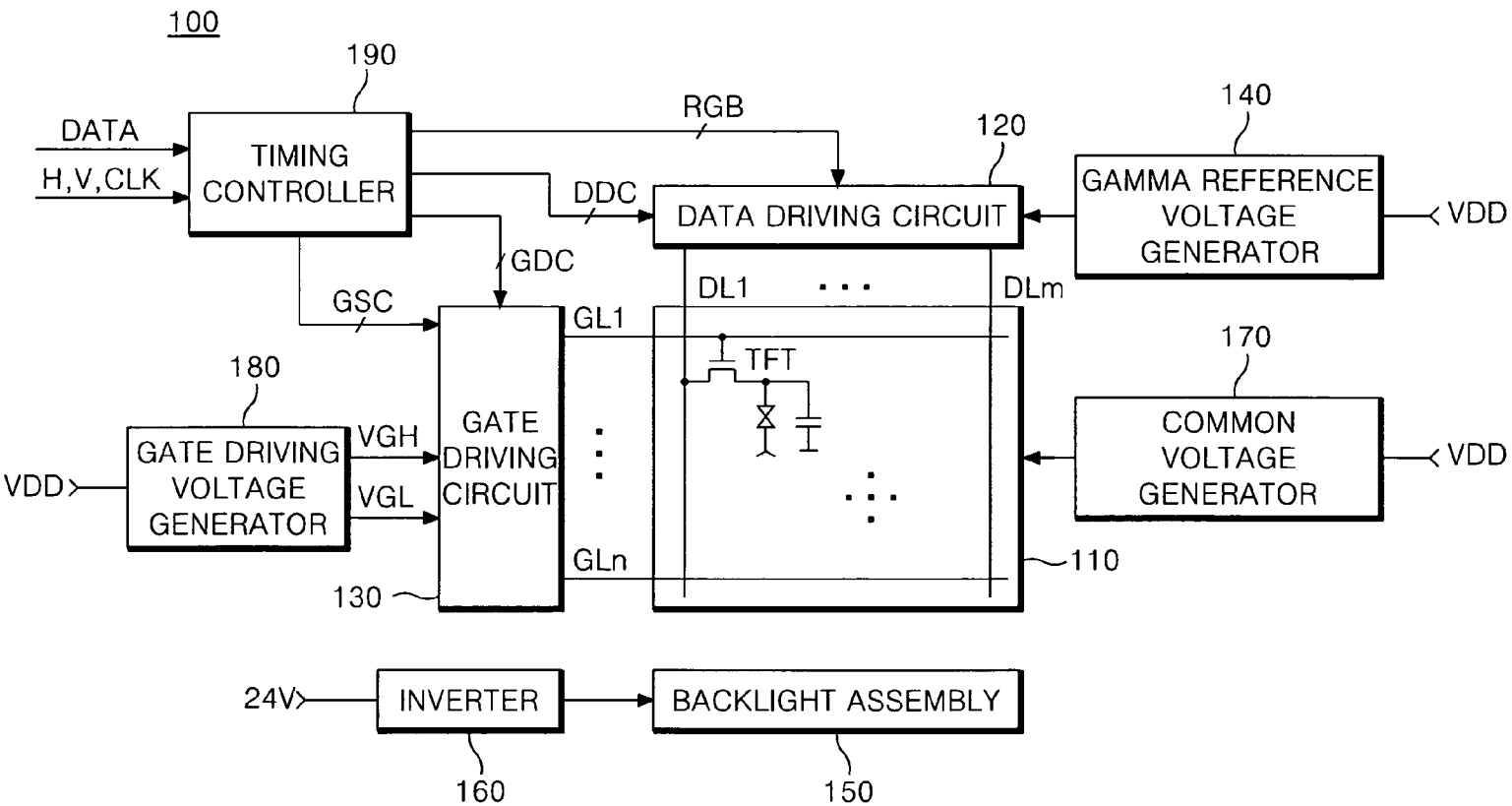
FIG. 2 RELATED ART
FIG. 2 is a block diagram showing a configuration of the liquid crystal display of the related art.
Figure 3:
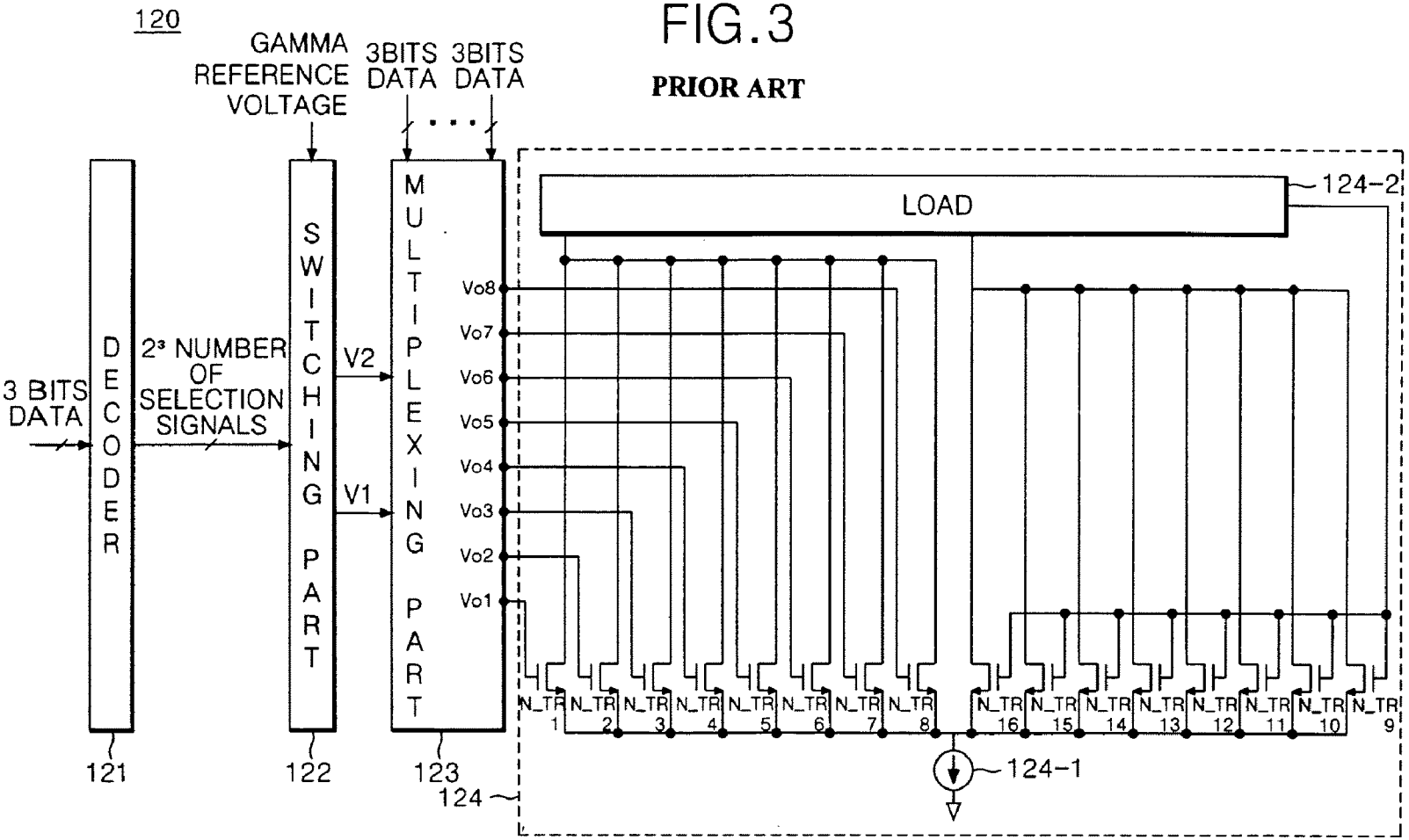
FIG.3 PRIOR ART
FIG. 3 is a diagram showing a configuration of a data driving circuit of the liquid crystal display of the related art.
Figure 5:
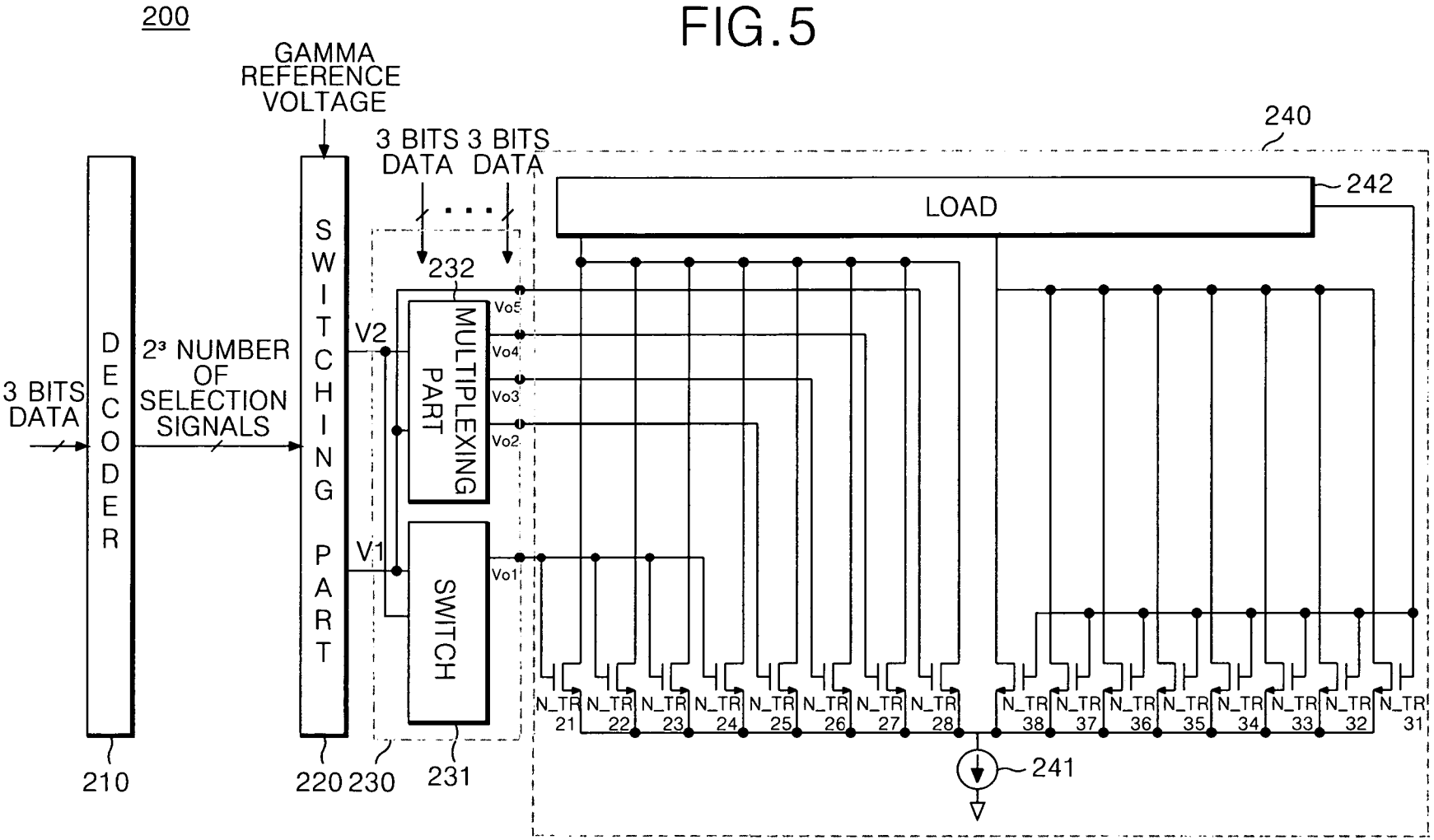
FIG. 5 is a diagram showing the structure of a data driving circuit of a liquid crystal display according to an embodiment of the present invention.

FIG. 5 is a diagram showing a configuration of a data driving circuit of a liquid crystal display according to an embodiment of the present invention.

Referring to FIG. 5, a data driving circuit 200 according to an embodiment of the present invention includes a decoder 210, a switching part 220, a voltage distributor 230, and an output buffer 240. The decoder 210 receives n bits data and outputs $2^n$ selection signals. The switching part 220 switches a gamma reference voltage from a gamma reference voltage generator (not shown) in accordance with $2^n$ selection signals supplied by the decoder 210 to output a first voltage V1 and a second voltage V2 to the voltage distributor 230. The voltage distributor 230 switches a first voltage V1 or a second voltage V2 from the switching part 220 to output the switched voltage in accordance with the most significant bit of each data among a plurality of n bits data. The voltage distributor 230 multiplexes a first voltage V1 and a second voltage V2 from the switching part 220 in accordance with one or more supplied data bits lower in significance than the most significant bit to over a plurality of outputs wherein the outputs each have the voltage levels of the first voltage V1 or the multiplexed second voltage V2. Furthermore, the voltage distributor 230 outputs a first voltage V1 from the switching part 220 irrespective of the input plurality of n bits data. The output buffer 240 is driven by a first voltage V1 and a second voltage V2 that are distributed by the voltage distributor 230 to buffer an input data.

The data driving circuit 200 according to the present invention receives data having n bits for process. However, for the purpose of illustration, an example in which the data driving circuit 200 receives 3 bit data for processing will be described.

The voltage distributor 230 includes a switch 231 and a multiplexing part 232. The switch 231 switches a first voltage V1 or a second voltage V2 received from the switching part 220 in accordance with the most significant bit of each data among the 3 bits of input data to output the switched voltage to the output buffer 240. The multiplexing part 232 multiplexes a first voltage V1 and a second voltage V2 from the switching part 220 in accordance with one or more bits lower in significance than the most significant bit to output a plurality of voltages having output levels selected from the multiplexed first voltage V1 and the multiplexed second voltage V2 to the output buffer 240.

The voltage distributor 230 includes first to fifth output terminals Vo1, Vo2, Vo3, Vo4, and Vo5. The first output terminal Vo1 outputs a first voltage V1 or a second voltage V2 output from switch 231 to output buffer 240. The second to fourth output terminals Vo2, Vo3, and Vo4 output a first voltage V1, or a first voltage V1 and a second voltage V2 that are multiplexed by the multiplexing part 232 to the output buffer 240. The fifth output terminal Vo5 outputs a first voltage V1 that is supplied from the switching part 220 without further alteration.

Figure 6:
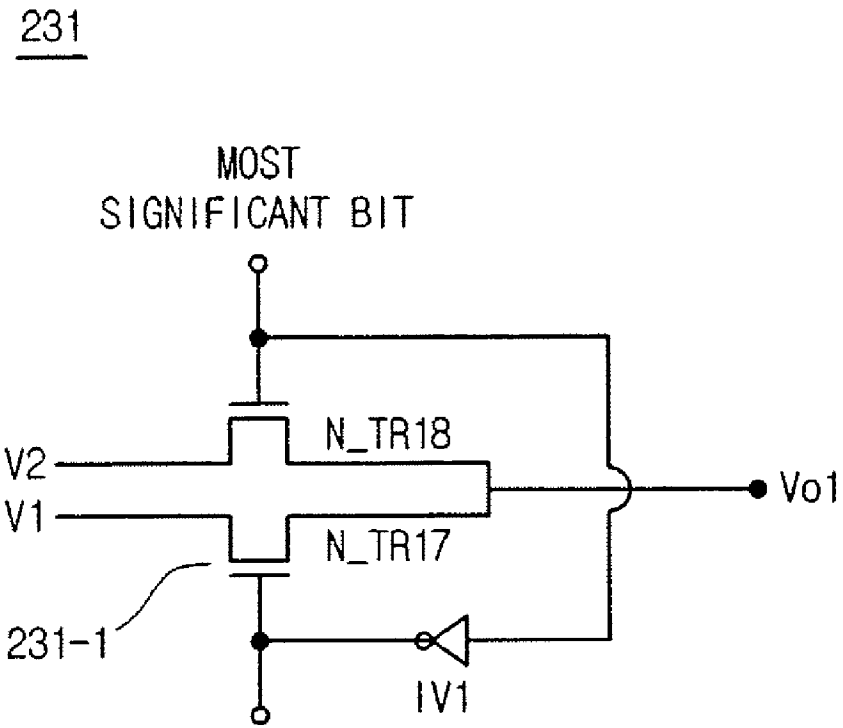
FIG. 6 is a circuit diagram of a switch which is included in the voltage distributor in FIG. 5 according to an embodiment of the present invention.

FIG. 6 illustrates the circuit configuration for an embodiment of the switch 231 shown in FIG. 5.

Referring to FIG. 6, the switch 231 includes a transmission gate 231-1 that includes two NMOS transistors N_TR17 and N_TR18 and an inverter IV1. The inverter IV1 inverts a level of the most significant bit.

The NMOS transistor N_TR17 of the transmission gate 231-1 includes a gate that is connected to an output terminal of the inverter IV1, a drain to which a first voltage V1 is applied from the switching part 230, and a source that is connected to the first output terminal Vo1.

The NMOS transistor N_TR18 of the transmission gate 231-1 includes a gate to which the most significant bit is applied, a drain to which a second voltage V2 is applied from the switching part 230, and a source that is connected to the first output terminal Vo1.

The inverter IV1 inverts a level of the input most significant bit to output the inverted bit to a gate of the NMOS transistor N_TR17. In other words, the inverter IV1 inverts a supplied most significant bit '0' to output a '1' and inverts a supplied most significant bit '1' to output a '0'.

For example, if a data of the most significant bit '0' is input to the inverter IV2, the most significant bit '0' is inverted and output as a '1' by inverter IV1. The '1' is then applied to the NMOS transistor N_TR17 of the transmission gate 231-1. The NMOS transistor N_TR17 of the transmission gate 231-1 is turned on by the inverted most significant bit of '1' and the first voltage V1 from the switching part 230 is conducted to the first output terminal Vo1. In addition, the input most significant bit '0' is directly applied to the gate of the NMOS transistor N_TR18 of the transmission gate 231-1 to turn off the NMOS transistor N_TR18. Accordingly, the NMOS transistor N_TR18 of the transmission gate 231-1 isolates the second voltage V2 applied from the switching part 220 from the first output terminal Vo1.

If data having a most significant bit of '1' is input, the NMOS transistor N_TR18 of the transmission gate 231-1 is turned on by the input most significant bit '1' to output a second voltage V2 with which a drain of the switching part 220 is applied from the switching part 220 via the first output terminal Vo1. The input most significant bit '1' is inverted to a '0' by the inverter IV1 to be applied to the NMOS transistor N_TR17 of the transmission gate 231-1. Accordingly, the NMOS transistor N_TR17 of the transmission gate 231-1 is turned-off by the inverted most significant bit '0' to isolate the first voltage V1 applied from the switching part 220 from the first output terminal Vo1.

The voltage distributor 230 applies the most significant bit among the input 3 bits of data to the transmission gate 231-1 of the switch 231, and applies the 2 remaining bits lower in significance than the most significant bit to the multiplexing part 232.

The multiplexing part 232 multiplexes a first voltage V1 and a second voltage V2 from the switching part 220 in accordance with the lower 2 bits among the input plurality of 3 bits data to output the multiplexed voltages to the second output terminals Vo2 to Vo4. A multiplexing and an output function of such a multiplexing part 123 will be described with reference to FIG. 7. Furthermore, the output function of the switch 231 will be described in detail with reference to FIG. 7.

Referring to FIG. 7, if '000' data is input to the voltage distributor 230, the switch 231 switches a first voltage V1 from the switching part 220 in accordance with the most significant bit '0' to output the switched voltage V1 to the output buffer 240 via the first output terminal Vo1. Furthermore, the multiplexing part 232 multiplexes only first voltage V1 of a first voltage V1 and a second voltage V2 from the switching part 220 in accordance with lower 2 bits '00' to output the three first voltages V1 to the output buffer 240 via the second to fourth output terminals Vo2 to Vo4, respectively. In this case, the voltage distributor 230 outputs a first voltage V1 from the switching part 220 to the output buffer 240 via the fifth output terminal Vo5 irrespective of the input data bits.

If '001' data is input to the voltage distributor 230, the switch 231 switches a first voltage V1 from the switching part 220 in accordance with the most significant bit '0' to output the switched voltage V1 to the output buffer 240 via the first output terminal Vo1. Furthermore, the multiplexing part 232 multiplexes a first voltage V1 and a second voltage V2 from the switching part 220 in accordance with lower 2 bits '01' to output two first voltages V1 and one second voltage V2 to the output buffer 240 via the second to fourth output terminals Vo2 to Vo4, respectively. In this case, the voltage distributor 230 outputs a first voltage V1 from the switching part 220 to the output buffer 240 via the fifth output terminal Vo5 irrespective of the input '001' data.

If '010' data is input to the voltage distributor 230, the switch 231 switches a first voltage V1 from the switching part 220 in accordance with the most significant bit '0' to output the switched voltage V1 to the output buffer 240 via the first output terminal Vo1. Furthermore, the multiplexing part 232 multiplexes a first voltage V1 and a second voltage V2 from the switching part 220 in accordance with lower 2 bits '10' to output two second voltages V2 and the one first voltage V1 to the output buffer 240 via the second to fourth output terminals Vo2 to Vo4, respectively. In this case, the voltage distributor 230 outputs a first voltage V1 from the switching part 220 to the output buffer 240 via the fifth output terminal Vo5 irrespective of the input '010' data.

If '011' data is input to the voltage distributor 230, the switch 231 switches a first voltage V1 from the switching part 220 in accordance with the most significant bit '0' to output the switched voltage V1 to the output buffer 240 via the first output terminal Vo1. Furthermore, the multiplexing part 232 multiplexes only second voltage V2 of a first voltage V1 and a second voltage V2 from the switching part 220 in accordance with lower 2 bits '11' to output three second voltages V2 to the output buffer 240 via the second to fourth output terminals Vo2 to Vo4, respectively. In this case, the voltage distributor 230 outputs a first voltage V1 from the switching part 220 to the output buffer 240 via the fifth output terminal Vo5 irrespective of the input '011' data.

If '100' data is input to the voltage distributor 230, the switch 231 switches a second voltage V2 from the switching part 220 in accordance with the most significant bit '1' to output the switched voltage V2 to the output buffer 240 via the first output terminal Vo1. Furthermore, the multiplexing part 232 multiplexes only first voltage V1 of a first voltage V1 and a second voltage V2 from the switching part 220 in accordance with lower 2 bits '00' to output the three first voltages V1 to the output buffer 240 via the second to fourth output terminals Vo2 to Vo4, respectively. In this case, the voltage distributor 230 outputs a first voltage V1 from the switching part 220 to the output buffer 240 via the fifth output terminal Vo5 irrespective of the input '100' data.

If '101' data is input to the voltage distributor 230, the switch 231 switches a second voltage V2 from the switching part 220 in accordance with the most significant bit '1' to output the switched voltage V2 to the output buffer 240 via the first output terminal Vo1. Furthermore, the multiplexing part 232 multiplexes a first voltage V1 and a second voltage V2 from the switching part 220 in accordance with lower 2 bits '01' to output the two first voltages V1 and the one second voltage V2 to the output buffer 240 via the second to fourth output terminals Vo2 to Vo4, respectively. In this case, the voltage distributor 230 outputs a first voltage V1 from the switching part 220 to the output buffer 240 via the fifth output terminal Vo5 irrespective of the input '101' data.

If '110' data is input to the voltage distributor 230, the switch 231 switches a second voltage V2 from the switching part 220 in accordance with the most significant bit '1' to output the switched voltage V2 to the output buffer 240 via the first output terminal Vo1. Furthermore, the multiplexing part 232 multiplexes a first voltage V1 and a second voltage V2 from the switching part 220 in accordance with lower 2 bits '10' to output the two second voltages V2 and the one first voltage V1 to the output buffer 240 via the second to fourth output terminals Vo2 to Vo4, respectively. In this case, the voltage distributor 230 outputs a first voltage V1 from the switching part 220 to the output buffer 240 via the fifth output terminal Vo5 irrespective of the input '110' data.

If '111' data is input to the voltage distributor 230, the switch 231 switches a second voltage V2 from the switching part 220 in accordance with the most significant bit '1' to output the switched voltage V2 to the output buffer 240 via the first output terminal Vo1. Furthermore, the multiplexing part 232 multiplexes only second voltage V2 of a first voltage V1 and a second voltage V2 from the switching part 220 in accordance with lower 2 bits '11' to output the three second voltages V2 to the output buffer 240 via the second to fourth output terminals Vo2 to Vo4, respectively. In this case, the voltage distributor 230 outputs a first voltage V1 from the switching part 220 to the output buffer 240 via the fifth output terminal Vo5 irrespective of the input '111' data.

Referring again to FIG. 5, the output buffer 240 includes a current source 241, eight NMOS transistors N_TR21 to N_TR28, and eight NMOS transistors N_TR31 to N_TR38. The current source 241 switches the applied current to a ground. Eight NMOS transistors N_TR21 to N_TR28 are driven by a first voltage V1 or a second voltage V2 that is output from the voltage distributor 230 to supply a current from a load 242 to the current source 241. Eight NMOS transistors N_TR31 to N_TR38 are driven by a voltage from the load 242 to supply a current from the load 242 to the current source 241. In this case, eight NMOS transistors N_TR21 to N_TR28 and eight NMOS transistors N_TR31 to N_TR38 are arranged to be symmetrical to each other.

The NMOS transistors N_TR21 to N_TR24 include a gate that is commonly connected to the first output terminal Vo1 of the voltage distributor 230, a drain that is commonly connected to the load 242, and a source that is commonly connected to the current source 241. The NMOS transistors N_TR21 to N_TR24 are driven by a first voltage V1 that is output via the first output terminal Vo1 of the voltage distributor 230 to supply a current from the load 242 to the current source 241.

The NMOS transistors N_TR25 includes a gate that is connected to the second output terminal Vo2 of the voltage distributor 230, a drain that is connected to the load 242, and a source that is connected to the current source 241. The NMOS transistor N_TR25 is driven by a first voltage V1 or a second voltage V2 that is output via the second output terminal Vo2 of the voltage distributor 230 to supply a current from the load 242 to the current source 241.

The NMOS transistors N_TR26 includes a gate that is connected to the third output terminal Vo3 of the voltage distributor 230, a drain that is connected to the load 242, and a source that is connected to the current source 241. The NMOS transistor N_TR26 is driven by a first voltage V1 or a second voltage V2 that is output via the third output terminal Vo3 of the voltage distributor 230 to supply a current from the load 242 to the current source 241.

The NMOS transistors N_TR27 includes a gate that is connected to the fourth output terminal Vo2 of the voltage distributor 230, a drain that is connected to the load 242, and a source that is connected to the current source 241. The NMOS transistor N_TR27 is driven by a first voltage V1 or a second voltage V2 that is output via the fourth output terminal Vo4 of the voltage distributor 230 to supply a current from the load 242 to the current source 241.

The NMOS transistors N_TR28 includes a gate that is connected to the fifth output terminal Vo5 of the voltage distributor 230, a drain that is connected to the load 242, and a source that is connected to the current source 241. The NMOS transistor N_TR28 is driven by a first voltage V1 that is output via the fifth output terminal Vo5 of the voltage distributor 230 to supply a current from the load 242 to the current source 241.

Eight NMOS transistors N_TR31 to N_TR38 have a gate and a drain that are connected to the load 242, and a source that is connected to the current source 241. Eight NMOS transistors N_TR31 to N_TR38 are driven by a voltage from the load 242 to supply a current from the load 242 to the current source 241.

The NMOS transistors N_TR21 to N_TR28 and the NMOS transistors N_TR31 to N_TR38 of the output buffer 240 have the same size. For example, the NMOS transistors N_TR21 to N_TR28 and the NMOS transistors N_TR31 to N_TR38 of the output buffer 240 may be realized to have a W/L size. Herein, W represents a width of the transistor, and L represents a length of the transistor.

As described above, in a data driver according to the present invention, if n bits data is input to the voltage distributor 230, the data driving circuit 200 outputs half (i.e. $2^n/2$ of $2^n$) voltages to be output from the voltage distributor 230 via a single output terminal. Thus, if the number of bits of input data is increased, the number of output terminals of the voltage distributor 230 and the number of signal line of the output buffer 240 that is connected to the output terminal are not doubly increased as is the case for the data driving circuit of the related art, but are increased instead less than one and a half times. As a result, a circuit structure of the data driving circuit of the present invention is more simply realized than the data driving circuit of the related art, and an area occupied by the data driving circuit may be reduced.

Figure 8:
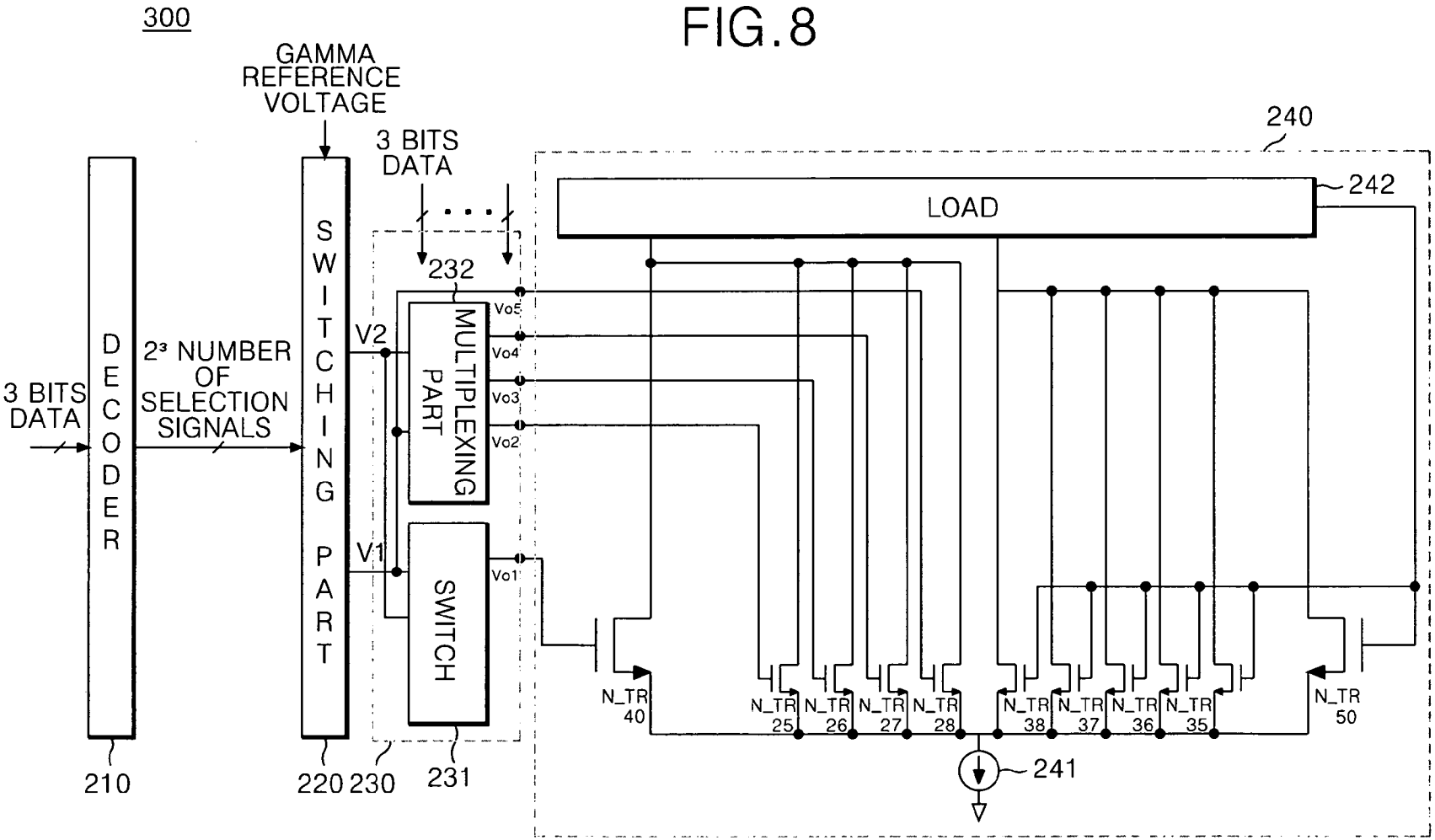
FIG. 8 is a diagram showing the structure of a data driving circuit of a liquid crystal display according to another embodiment of the present invention.

FIG. 8 is a diagram showing a configuration of a data driving circuit of a liquid crystal display according to another embodiment of the present invention.

Referring to FIG. 8, a data driving circuit 300 according to another embodiment of the present invention includes a decoder 210, a switching part 220, and a voltage distributor 230 similar to that of the data driving circuit 200 illustrated in FIG. 5.

Additionally, the data driving circuit 300 includes an output buffer 310 that has eight NMOS transistors N_TR25 to N_TR28 and N_TR35 to N_TR38 having the same size and two NMOS transistors N_TR40 and N_TR50 having a fourfold size compared to eight NMOS transistors N_TR25 to N_TR28 and N_TR35 to N_TR38 of the first embodiment.

For example, if the eight NMOS transistors N_TR25 to N_TR28 and N_TR35 to N_TR38 are implemented to have a W/L size, the NMOS transistors N_TR40 and N_TR50 may be implemented to have a 4 W/L size.

Herein, five NMOS transistors N_TR25 to N_TR28 and N_TR40 and five NMOS transistors N_TR35 to N_TR38 and N_TR50 are arranged to be symmetrical to each other.

The NMOS transistor N_TR40 includes a gate that is connected to the first output terminal Vo1 of the voltage distributor 230, a drain that is connected to the load 242, and a source that is connected to the current source 241. The NMOS transistor N_TR40 is driven by a first voltage V1 that is output via the first output terminal Vo1 of the voltage distributor 230 to supply a current from the load 242 to the current source 241. The size of the NMOS transistor N_TR40 is made larger as the number of NMOS transistors having gates connected to an output terminal of the voltage distributor 230 is increased.

The NMOS transistors N_TR50 includes a gate and a drain that are connected to the load 242, and a source that is connected to the current source 241. The NMOS transistor N_TR50 is driven by a voltage from the load 242 to supply a current from the load 242 to the current source 241. The size of the NMOS transistors N_TR50 is increased as the number of NMOS transistor having a gate connected to the load 242 is increased.

As described above, a data driver in accordance with the present invention selectively switches and multiplexes voltages in accordance with a bit order of the input data and can have a simplified structure and the circuitry of the data driver may occupy a smaller area.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. A data driving circuit of a liquid crystal display, comprising:

a decoder that receives n bits data and outputs $2^n$ selection signals where n is a natural number greater than 2;

a switching part that switches a gamma reference voltage from a gamma reference voltage generator in accordance with the $2^n$ selection signals supplied by the decoder to output a first voltage and a second voltage;

a voltage distributor that selects one of the first voltage and the second voltage from the switching part as a first output voltage in accordance with the most significant bit of input data including a plurality of n data bits, that multiplexes the first voltage and the second voltage to be output as one or more multiplexed output voltages wherein each of the one or more multiplexed output voltages is a voltage level of one of the first voltage and the second voltage selected in accordance with bits of the input data other than the most significant bit, and that outputs the first voltage as a final output voltage where n is a natural number greater than 2; and an output buffer that is driven by the first output voltage, the one or more multiplexed output voltage, and the final output voltage, wherein the voltage distributor includes a switch that switches one of the first voltage and the second voltage as a switched output voltage in accordance with the most significant bit of the 3 bit input data to be output to the output buffer, wherein the switch includes an inverter that inverts a level of the most significant bit of the input data having n bits to be output as an inverted most significant bit data and a transmission gate that selectively switches one of the first voltage and the second voltage to be output to the output buffer via a first output terminal in accordance with the most significant bit of the input data and the inverted most significant bit data output by the inverter, and wherein the voltage distributor further includes a multiplexing part that receives the first voltage and the second voltage and outputs the one or more multiplexed output voltages to the output buffer, each of the one or more multiplexed output voltages being one of the first voltage and the second voltage selected in accordance with bits of the 3 bit input data other than the most significant bit of the 3 bit input data.

2. The data driving circuit of the liquid crystal display according to claim 1, wherein the voltage distributor includes:

the first output terminal that outputs the switched output voltage to the output buffer;

second to fourth output terminals that output one of the one or more multiplexed output voltages output by the multiplexing part, respectively; and a fifth output terminal that outputs the first voltage.

3. The data driving circuit of the liquid crystal display according to claim 1, wherein the transmission gate includes:

a first NMOS transistor that is turned on in response to the inverted most significant bit data output by the inverter to connect the first voltage to the first output terminal; and a second NMOS transistor that is turned on in response to the most significant bit of the input data to connect the second voltage to the first output terminal, wherein the first NMOS transistor includes a gate that is connected to an output terminal of the inverter, a drain to which the first voltage is applied from the switching part and source that is connected to the first output terminal, and wherein the second NMOS transistor includes a gate to which the most significant bit is applied, a drain to which the second voltage is applied from the switching part and a source that is connected to the first output terminal.

4. The data driving circuit of the liquid crystal display according to claim 3, wherein when '000' data are received by the voltage distributor, the switch connects the first voltage in response to the most significant bit of 0 of the received '000' data to output the first voltage to the output buffer via the first output terminal, and the multiplexing part multiplexes the first voltage and the second voltage in response to the lower 2 bits '00' of the received '000' data to output the first voltage to each of the second to fourth output terminals, when '001' data are received by the voltage distributor, the switch connects the first voltage in response to the most significant bit 0 of the received '001' data to output the first voltage to the output buffer via the first output terminal, and the multiplexing part multiplexes the first voltage and the second voltage in response to lower 2 bits '01' of the received '001' data to output the second voltage and the two first voltages to the output buffer via the second to fourth output terminals, respectively, when '010' data are received by the voltage distributor, the switch connects the first voltage in response to the most significant bit 0 of the received '010' data to output the first voltage to the output buffer via the first output terminal, and the multiplexing part multiplexes the first voltage and the second voltage in response to lower 2 bits '10' of the received '010' data to output the two second voltages and the first voltage to the output buffer via the second to fourth output terminals, respectively, when '011' data are received by the voltage distributor, the switch connects the first voltage in response to the most significant bit 0 of the received '011' data to output it to output the first voltage to the output buffer via the first output terminal, and the multiplexing part multiplexes the first voltage and the second voltage in response to lower 2 bits '11' of the received '011' data to output three the second voltage to the output buffer via each of the second to fourth output terminals, when '100' data are received by the voltage distributor, the switch connects the second voltage in response to the most significant bit 1 of the received '100' data to output the second voltage to the output buffer via the first output terminal, and the multiplexing part multiplexes the first voltage and the second voltage in response to lower 2 bits '00' of the received '100' data to output the first voltage to the output buffer via each of the second to fourth output terminals, when '101' data are received by the voltage distributor, the switch connects the second voltage in response to the most significant bit 1 of the received '101' data to output the second voltage to the output buffer via the first output terminal, and the multiplexing part multiplexes the first voltage and the second voltage in response to lower 2 bits '01' of the received '101' data to output the second voltage level and the two first voltages to the output buffer via the second to fourth output terminals, respectively, when '110' data are received by the voltage distributor, the switch connects the second voltage in response to the most significant bit 1 of the received '110' data to output the second voltage to the output buffer via the first output terminal, and the multiplexing part multiplexes the first voltage and the second voltage in response to lower 2 bits '10' of the received '110' data to output the two second voltages and the first voltage to the output buffer via respective ones of the second to fourth output terminals, respectively, and when '111' data are received by the voltage distributor, the switch connects the second voltage in response to the most significant bit 1 of the received '111' data to output the second voltage to the output buffer via the first output terminal, and the multiplexing part multiplexes the second voltage of the first voltage and the second voltage in response to lower 2 bits '11' of the received '111' data to output three the second voltage to the output buffer via each of the second to fourth output terminals.

5. The data driving circuit of the liquid crystal display according to claim 3, wherein the output buffer includes:

a current source that switches an applied current to a ground;

third to ninth NMOS transistors that are each driven by output voltages, each of the third to ninth NMOS transistors having one of the first voltage and the second voltage output by the voltage distributor to supply a current from a load to the current source;

a tenth NMOS transistor that is driven by the final output voltage output by the voltage distributor having the first voltage level to supply a corresponding current from the load to the current source;

eleventh to seventeenth NMOS transistors that are each driven by a voltage from the load to supply a corresponding current from the load to the current source; and an eighteenth NMOS transistor driven by a voltage from the load to supply a corresponding current from the load to the current source, and wherein the third to the eighteenth NMOS transistors have the same size.

6. The data driving circuit of the liquid crystal display according to claim 5, wherein each of the third to the sixth NMOS transistors includes a gate commonly connected to the first output terminal, a drain commonly connected to the load, and a source commonly connected to the current source;

the seventh NMOS transistor includes a gate connected a second output terminal, a drain connected to the load, and a source connected to the current source;

the eighth NMOS transistor includes a gate connected a third output terminal, a drain connected to the load, and a source connected to the current source;

the ninth NMOS transistor includes a gate connected to a fourth output terminal, a drain connected to the load, and a source connected to the current source; and the tenth NMOS transistor includes a gate connected to a fifth output terminal, a drain connected to the load, and a source connected to the current source.

7. The data driving circuit of the liquid crystal display according to claim 3, wherein the output buffer includes:

a current source that switches an applied current to a ground;

a third NMOS transistor that is driven by the switched output voltage output from the voltage distributor to supply a current from a load to the current source;

fourth to sixth NMOS transistors that are each driven by output voltages, each of the fourth to the sixth NMOS transistors having one of the first voltage and the second voltage output by the voltage distributor to supply a current from the load to the current source;

a seventh NMOS transistor that is driven by the final output voltage output by the voltage distributor having the first voltage to supply a current from the load to the current source;

an eighth NMOS transistor that is driven by a voltage from the load to supply a current from the load to the current source;

ninth to eleventh NMOS transistors that are each driven by a voltage from the load to supply a current from the load to the current source; and a twelfth NMOS transistor that is driven by a voltage from the load to supply a current from the load to the current source, and wherein the fourth to the seventh NMOS transistors and the ninth to the twelfth NMOS transistors have the same size, and a size of the third NMOS transistor has substantially the same as a sum of sizes of the fourth to the seventh NMOS transistors and a size of the eighth NMOS transistor is substantially the same as a sum of sizes of the ninth to the twelfth NMOS transistors.

8. The data driving circuit of the liquid crystal display according to claim 7, wherein the third NMOS transistor includes a gate connected to the first output terminal, a drain connected to the load, and a source connected to the current source;

the fourth NMOS transistor includes a gate connected a second output terminal, a drain connected to the load, and a source connected to the current source;

the fifth NMOS transistor includes a gate connected to a third output terminal, a drain connected to the load, and a source connected to the current source;

the sixth NMOS transistor includes a gate connected to a fourth output terminal, a drain connected to the load, and a source connected to the current source; and the seventh NMOS transistor includes a gate connected to a fifth output terminal, a drain connected to the load, and a source connected to the current source.

9. A data driving circuit of a liquid crystal display, comprising:

a decoder that receives n bits data and outputs $2^n$ selection signals where n is a natural number greater than 2;

a switching part that switches a gamma reference voltage from a gamma reference voltage generator in accordance with the $2^n$ selection signals supplied by the decoder to output a first voltage and a second voltage;

a voltage distributor that switches the first voltage or the second voltage which is inputted from the switching part in accordance with the most significant bit of each data among the plurality of n bits data to output the first voltage or the second voltage, that multiplexes the first voltage and the second voltage in accordance with a lower bit less than the most significant bit to output the multiplexed first voltage or the multiplexed second voltage or output the multiplexed first voltage and the multiplexed second voltage, and that outputs the first voltage irrespective of the inputted plurality of n bits data wherein n is a natural number greater than 2; and an output buffer that is driven by the first voltage and the second voltage, which are distributed by the voltage distributor, to buffer an input data, wherein the voltage distributor includes a switch that switches the first voltage or the second voltage in accordance with the most significant bit of each data among the plurality of 3 bits data to output the first voltage or the second voltage to the output buffer, wherein the switch includes an inverter that inverts a level of the most significant bit of each data among the inputted plurality of n bits data and a transmission gate that selectively switches the first voltage or the second voltage to output the first voltage or the second voltage to the output buffer via a first output terminal in accordance with the most significant bit of each data among the inputted plurality of n bits data and the most significant bit which is inverted by the inverter, and wherein the voltage distributor further includes a multiplexing part that multiplexes the first voltage and the second voltage to output the multiplexed first voltage or the multiplexed second voltage to the output buffer, or to output the multiplexed first voltage and the multiplexed second voltage to the output buffer in accordance with a lower bit data less than the most significant bit.

10. The data driving circuit of the liquid crystal display according to claim 9, wherein the voltage distributor includes:

the first output terminal that outputs the first voltage or the second voltage which is switched via the switch to the output buffer, at least one of second to fourth output terminals that outputs the first voltage and the second voltage which are multiplexed by the multiplexing part to the output buffer, and a fifth output terminal that outputs the first voltage.

11. The data driving circuit of the liquid crystal display according to claim 9, wherein the transmission gate includes:

a first NMOS transistor that is turned on by the most significant bit which is inverted by the inverter to output the first voltage via the first output terminal; and a second NMOS transistor that is turned on by the most significant bit of each data among the inputted plurality of n bits data to output the second voltage via the first output terminal, wherein the first and the second NMOS transistors are selectively turned on, wherein the first NMOS transistor includes a gate that is connected to an output terminal of the inverter, a drain to which the first voltage is applied from the switching part and source that is connected to the first output terminal, and wherein the second NMOS transistor includes a gate to which the most significant bit is applied, a drain to which the second voltage is applied from the switching part and a source that is connected to the first output terminal.

12. The data driving circuit of the liquid crystal display according to claim 11, wherein the output buffer includes:

a current source that switches the applied current to a ground;

at least one of third to ninth NMOS transistors that are driven by the first voltage and the second voltage which are outputted from the voltage distributor to supply a current from a load to the current source;

a tenth NMOS transistor that is driven by the first voltage which is outputted from the voltage distributor to supply a current from the load to the current source;

at least one of eleventh to seventeenth NMOS transistors that are driven by a voltage from the load to supply a current from the load to the current source; and an eighteenth NMOS transistor that is driven by a voltage from the load to supply a current from the load to the current source, and wherein the third to the eighteenth NMOS transistors have the same size.

13. The data driving circuit of the liquid crystal display according to claim 11, wherein the output buffer includes:

a current source that switches the applied current to a ground;

a third NMOS transistor that is driven by the first voltage or the second voltage which is outputted from the voltage distributor to supply a current from a load to the current source;

at least fourth to sixth NMOS transistors that are driven by the first voltage or the second voltage which is outputted from the voltage distributor to supply a current from the load to the current source;

a seventh NMOS transistor that is driven by the first voltage which is outputted from the voltage distributor to supply a current from the load to the current source;

an eighth NMOS transistor that is driven by a voltage from the load to supply a current from the load to the current source;

at least ninth to eleventh NMOS transistors that are driven by a voltage from the load to supply a current from the load to the current source; and a twelfth NMOS transistor that is driven by a voltage from the load to supply a current from the load to the current source, and wherein the fourth to the seventh NMOS transistors and the ninth to the twelfth NMOS transistors have the same size, and a size of the third NMOS transistor is the same as a sum of sizes of the fourth to the seventh NMOS transistors and a size of the eighth NMOS transistor is the same as a sum of sizes of the ninth to the twelfth NMOS transistors.

14. The data driving circuit of the liquid crystal display according to claim 13, wherein the third NMOS transistor includes a gate which is connected to the first output terminal, a drain which is connected to the load, and a source which is connected to the current source;

at least the fourth NMOS transistor includes a gate which is connected to at least the one second output terminal, a drain which is connected to the load, and a source which is connected to the current source;

at least the fifth NMOS transistor includes a gate which is connected to at least the one third output terminal, a drain which is connected to the load, and a source which is connected to the current source;

at least the sixth NMOS transistor includes a gate which is connected to at least a fourth output terminal, a drain which is connected to the load, and a source which is connected to the current source; and the seventh NMOS transistor includes a gate which is connected to a fifth output terminal, a drain which is connected to the load, and a source which is connected to the current source.

15. The data driving circuit of the liquid crystal display according to claim 9, wherein at least one of third to sixth NMOS transistors include a gate which is commonly connected to the first output terminal, a drain which is commonly connected to the load, and a source which is commonly connected to the current source;

at least a seventh NMOS transistor includes a gate which is connected to at least a second output terminal, a drain which is connected to the load, and a source which is connected to the current source;

at least an eighth NMOS transistor includes a gate which is connected to at least a third output terminal, a drain which is connected to the load, and a source which is connected to the current source;

at least a ninth NMOS transistor includes a gate which is connected to at least a fourth output terminal, a drain which is connected to the load, and a source which is connected to the current source; and a tenth NMOS transistor includes a gate which is connected to a fifth output terminal, a drain which is connected to the load, and a source which is connected to the current source.

* * * * *